United States Patent [19]

Russwurm et al.

[11] Patent Number: 4,923,528

[45] Date of Patent: May 8, 1990

[54] METHOD FOR MANUFACTURING ROLLED STEEL PRODUCTS

[75] Inventors: Dieter Russwurm, Puchheim; Erich Richartz, Peine, both of Fed. Rep. of Germany

[73] Assignee: Max Aicher, Freilassing, Fed. Rep. of Germany

[21] Appl. No.: 335,967

[22] PCT Filed: Sep. 18, 1987

[86] PCT No.: PCT/EP87/00537

§ 371 Date: Mar. 14, 1988

§ 102(e) Date: Mar. 14, 1988

[87] PCT Pub. No.: WO88/02031

PCT Pub. Date: Mar. 24, 1988

[30] Foreign Application Priority Data

Sep. 19, 1986 [DE] Fed. Rep. of Germany ..... 3631928

[51] Int. Cl.[5] ..... C21D 8/00

[52] U.S. Cl. ..... 148/12.4; 148/12 B; 148/12 F

[58] Field of Search ..... 148/12 B, 12.4, 12 F

[56] References Cited

U.S. PATENT DOCUMENTS 4,203,783 5/1980 Economopoulos et al. ..... 148/12.4

FOREIGN PATENT DOCUMENTS 1725544 2/1986 European Pat. Off. .

46-27138 8/1971 Japan ..... 148/12.4

62-86125 4/1987 Japan ..... 148/12.4

65413 8/1972 Luxembourg .

*Primary Examiner*—Deborah Yee

[57] ABSTRACT

A method for manufacturing rolled steel products, especially of threaded tension steels or the like, is described, in accordance with which the steel with a C-content of 0.50 to 0.80 W %, a Si-content of 0.20 to 0.60 W %, and a Mn-content of 0.30 to 0.80 W %, after hot rolling is surface quenched by means of cooling from the rolling heat at the output side of the finishing equipment so that the material in a peripheral zone is immediately and entirely converted to martensite, while the heat which remains in the core zone during the subsequent cooling effects an annealing the martensitic peripheral zone not beyond the range of the intermediate stage, and which in accordance with the invention is characterized in that after the cooling a cold working follows, and then an annealing. The total reduction amounts preferably to 0.5 to 1.5%; the annealing is preferably carried out at a temperature in the range of 350° C. to 380° C. and during a period of maximum temperature of 5 to 60 seconds. By means of this method rolled steel products, such as for example tension steels, can be made in a simple and economical way, which products have ductility and mechanical properties entirely meeting the demands required for construction.

16 Claims, No Drawings

METHOD FOR MANUFACTURING ROLLED STEEL PRODUCTS

The invention concerns a process for manufacturing rolled steel products, especially structural steels such as, for example, tension steels.

With respect to construction steels (heat treated steels) such as, for example, tension steels, high demands are placed with regard to mechanical properties. Tension steels are used in building construction as tensioning members for pre-stressed concrete, as anchor steels for earth and rock anchors, as concrete form anchors, for suspension cables for suspension bridges, cable ropes for cable rope bridges, staying and the like. For a portion of these applications tension steels, preferably with rod shaped across section are used in the strength class with yield points between 800 and 1000 $N/mm^2$ (0,2-limit) and tensile strengths between 1100 and 1300 $N/mm^2$. As to measurements, diameters from 12 to 50 mm, especially from 20 to 40 mm, come into question. This involves tension steels with smooth outer surfaces or steels with for example screw shaped inclined ribs. Other possible realizations for tension steels are wires and sheet steel.

Tension steels along with static strength must also possess a very high elastic limit and a good ductility. In the case of threaded tension steels, that is such to which a threaded anchor can be applied, a high wear resistance for the outer surface as well as resistance to corrosion is also important Further important requirements are good relaxation properties as well as an adequately high fatigue loading resistance. Rod shaped tension steels with diameters between about 12 and 50 mm are hot rolled to increase the yield point, subsequently stretched and then annealed to remove stress. According to these methods indeed the lesser requirements of the prescribed standards can be met, but the process is also with respect to the steel composition (typical analysis in W% (Weight Percentage): C 0.75, Si 0.80, Mn 1.50, P 0.020, S0.020, V 0.25) and the carrying out of the method quite expensive and associated with high production costs. Beside numerous production steps, residual hydrogen and metallurgical segregation represent for this steel a big problem. The disadvantageous effect of cracks appearing during the stretching, as also of cracks which occur later, and the general susceptibility to corrosion of such tension steel are known. The production disturbing high amount of rejects (scrap) in the plant represents another substantial cost factor.

A method for manufacturing rolled steel products, especially threaded tension steels and the like, is known from DE-OS 34 31 008, in which the steel with a C-content of from 0.50 to 0.80 W%, a Si-content of from 0.20 to 0.60 W%, and a Mn-content of from 0.30 to 0.80 W%, after hot rolling is cooled at the output side of the finishing equipment from the rolling heat, especially by means of water (in principle cooling gas comes into question), so that a quenching of the outer surface takes place such that the material in a peripheral zone is converted directly and entirely into martensite, while the heat which remains in the core zone during the subsequent cooling effects an annealing of the martensitic peripheral zone not beyond the range of the intermediate stage.

In accordance with this method it is possible to use starting compositions readily represented metallurgically and of cost effective analysis for the manufacture of a tension steel which is resistant to corrosion and having a wear resistant outer surface, which reduces the danger of mechanical damage and suits the steel to the application of threads. The tension steel obtained through this method exhibits moreover, along with a high yield point and a high strength, a high ductility or toughness above all at high temperatures, and it possesses along with low relaxation a high fatigue strength.

From LU-A-65 413 a method for manufacturing a non-heat treated steel is known, in which after the cooling a cold working is carried out with a following annealing. Since in the case of such steel, no metastable phase in the form of martensite appears which upon cold working can effect a breaking of the material, a transfer of these measures to a method according to DE-OS 34 31 008 cannot be considered obvious.

The object of the present invention is to provide an economical method for manufacturing rolled steel products, especially tension steels and which makes it possible to start from a simple and cost effective analysis and to obtain from it in a simple and easily carried out way a product with properties which correspond highly and reliably with those required for construction steels, especially tension steels. This problem is solved by the present invention.

The subject of the invention is a method for manufacturing rolled steel products, especially threaded tension steels or the like, from steels with a C-content of from 0.50 to 0.80 W%, Si-content of from 0.20 to 0.60 W%, and Mn-content of from 0.30 to 0.80 W%, wherein after hot rolling, at the output side of the finishing equipment the steel is cooled from the rolling heat especially by means of a cooling fluid, for example water, to effect such a quenching of the outer surface that the material in a peripheral zone is converted directly and entirely to martensite, while the heat remaining in the core zone during the subsequent cooling effects an annealing of the martensitic peripheral zone not beyond the range of the intermediate stage, which method is characterized in that after the foregoing a cold working takes place and then subsequently an annealing. Practical refinements of this method are the subjects of dependent claims 2 to 11.

With the method of the invention, through the method steps of cold working and then subsequent annealing a two layered steel obtained after hot rolling and outer surface quenching with annealed martensitic outer layer, end products are obtained which further have up to 0.8 W% chromium, up to 0.5, especially 0.4 W% copper, up to 0.15 W% vanadium, up to about 0.06 W% niobium, up to 0.03 W% phosphorus, up to 0.03 W% sulfur, traces of titanium and/or traces of boron and/or nickel in a quantity such that the sum of chromium and nickel carries a W% up to 0.8, especially up to 0.4, wherein these components can appear individually or in combination with one another.

The starting material can itself be manufactured in a customary way, for example in a block, or also as a continuous casting. A special treatment for removing hydrogen in either the liquid or the solid phase is also usually necessary.

The semi-finished material is rolled for example on a thin material rolling mill or a wire rolling mill to the end cross section. This hot rolling and the thereafter following controlled heat treatment (outer surface quenching) takes place preferably according to the method versions and conditions described in DE-OS 34 31 008.

The end rolling temperature of the finishing equipment is preferably so chosen that it lies closely above $A_3$ at the lower limit of the hot forming range. The end rolling temperature lies preferably between 860° and 1060° C., and especially between 950° and 1000° C. The annealing during the subsequent cooling takes place preferably such that the outer surface temperature of the peripheral zone in the time between the second and sixth seconds of the heat treatment, depending on the rod diameter, amounts to no more than about 500° C., and preferably amounts to between 400° and 500° C.

After the hot rolling and the controlled heat treatment as a result of which a yield point value of about 900 N/mm$^2$ has been reached, a cold forming then follows. As cold forming twisting comes for example into question. Preferred however is stretching since the resulting deformation is largely homogeneous over the cross section. The stretching is preferably done to a degree that corresponds in the stretch-strain line of the starting material somewhat to the region of (1.01 to 1.2)×Re, and especially (1.05 to 1.1)×Re, The total reduction amounts therefore preferably to 0.3 to 2.0%, and especially to 0.5 to 1.5%.

The stretching can take place in the handling of the steel in a known way and manner. Rods with a diameter of more than 15 mm ($d_s$ greater or equal to 15 mm) are preferably individually stretched, and in the case of wires a continuous stretching process can be undertaken as for example is usual in the case of concrete steels. After stretching there follows the annealing step of the invention to stabilize the defects and displacements obtained with the cold working. This annealing takes place at a temperature in the range of from 300° to 420° C., especially from 330° to 320° C., and most preferably in the range of from 350° to 380° C. The duration of maximum temperature amounts to preferably 5 to 60 seconds, and especially about 10 seconds. This annealing can be carried out in a usual way, for example in thermally heated ovens, or electrically with conductive delivery of current, and preferably the heating takes place inductively, since in this case especially short durations are possible.

With the method of the invention it is possible to manufacture construction steel, especially tension steel, in a simple and economical way, with the steel having a very high Re/Rm ratio; and with which method for example the time consuming and risky method step of effusion treatment is not necessary. The products manufactured according to the method of the invention are suited on the basis of their properties very well to the intended application; they can for their application have a usual form and can for example be formed as steel rods or wires with smooth outer surfaces, or with suitable threads, ribs and the like, as described for example in DE-OS 34 31 008. The products have sufficient ductility, a high $R_{P\,0.01}$ value (technical elasticity limit), a small relaxation and a sufficient elongation. As a comparison of example 1 (the method according to DE-OS 34 31 008) and example 2 (the method of the invention) shows, the products made according to the method of the present invention exhibit for similar breaking elongations, better values for the yield point ($R_e$), and the tensile strength ($R_m$) and the relaxation (T).

The following examples are intended to further explain the invention without limiting it.

EXAMPLES

EXAMPLE 1 (COMPARISON EXAMPLE)

A steel with the composition (in W%): C 0.68; Si 0.35; Mn 0.66; P 0.021 and S 0.025 was rolled as ribbed steel (threaded steel) and was subjected to the heat treatment method of DE-OS 34 31 008. The following values were obtained:

Yield Point ($R_e$): 900 N/mm$^2$
Tensile Strength ($R_m$): 1200 N/mm$^2$
Breaking Elongation ($A_{10}$): 10.3%
Relaxation ($T_{1000}$): 4 to 6% (1000 hours; i=0.8×Rm)

EXAMPLE 2 (METHOD OF THE INVENTION)

The product obtained from the method of example 1 was thereafter stretched 0.7% after which an annealing took place at 350° C. (10 seconds). The following values were obtained:

Yield Point ($R_e$): 1100 N/mm$^2$
Tensile Strength ($R_m$): 1250 N/mm$^2$
Breaking Elongation ($A_{10}$): 9.8%
Relaxation ($T_{1000}$): <2% (1000 hours; $_i$=0.8×Rm)
Bending Capacity: 5×$d_s$ (to 180°, no break)

The product obtained according to example 2 had a corrosion resistance of as good a value as the steel manufactured according to example 1.

The method of the invention especially distinguishes itself in that with a cost effectively obtainable starting material and with method steps simple to execute (for example without separate tempering steps) a product with improved material properties, especially improved yield point, tensile strength and relaxation, is obtained. It is also an advantage that all of the products obtained in accordance with the invention have been automatically tested as to their ability to withstand a tensile loading since these products have successfully endured the stretching treatment.

We claim:

1. A method for manufacturing rolled steel products with steel having a C-content of 0.50 to 0.80 Wt%, a Si-content of 0.20 to 0.60 Wt%, and Mn-content of 0.30 to 0.80 Wt%, said method comprising the steps of:

hot rolling said steel;

surface quenching said steel from the rolling heat at the output side of the rolling equipment by means of cooling so that a peripheral zone of said steel is converted to martensite, subsequently further cooling said steel, during which subsequent cooling the heat remaining in the core zone of said steel effects a partial annealing of the martensitic peripheral zone;

then cold working said steel; and thereafter annealing said steel.

2. The method of claim 1, wherein said cold working comprises stretching.

3. The method of claim 2, wherein said steel is reduced by 0.3 to 2.0%.

4. The method of claim 2, wherein said steel is reduced by 0.5 to 1.5%.

5. The method of claim 1, wherein said annealing step is carried out in a temperature range of 300° to 400° degrees C.

6. The method of claim 1, wherein said annealing step is carried out in a temperature range of 330° to 420° C.

7. The method of claim 1, wherein said annealing step is carried out in a temperature range of 350° to 380° C.

8. The method of claim 1, wherein said annealing step is carried out during a maximum temperature period of 5 to 60 seconds.

9. The method of claim 1, wherein said annealing step is carried out during a maximum temperature period of 10 seconds.

10. The method of claim 8, wherein said annealing step includes induction heating of said steel.

11. The method of claim 1, wherein said temperature of said steel at the output side of the rolling equipment lies at the lower limit of the heat formability of said steel barely over A3.

12. The method of claim 1, wherein said temperature of said steel at the output side of the rolling equipment is between 860° and 1060° C.

13. The method of claim 11, wherein said temperature of said steel at the output side of the rolling equipment is between 950° and 1000° C.

14. The method of claim 1, wherein during said subsequent cooling of said steel the outer surface temperature of said martensitic peripheral zone in the time period between the second and sixth seconds of the heat treatment does not exceed 500° C.

15. The method of claim 1, wherein during said subsequent cooling of said steel the outer surface temperature of said martensitic peripheral zone in the time period between the second and sixth seconds of the heat treatment is between 400° and 500° C.

16. The method of claim 1, wherein said steel comprises: up to 0.8 Wt% chromium, up to 0.5 Wt% copper, up to 0.15 Wt% vanadium, up to 0.06 Wt% niobium, up to 0.03 Wt% phosphorus, up to 0.03 Wt% sulfur, and possible traces of titanium, boron and nickel, and, wherein the sum of said chromium and said nickel amounts to up to 0.8 Wt%.

* * * * *